US005493787A

United States Patent [19]

Owens

[11] Patent Number: 5,493,787

[45] Date of Patent: Feb. 27, 1996

[54] CHALKLINE TOOL

[75] Inventor: Robert L. Owens, Shaftsbury, Vt.

[73] Assignee: The Stanley Works, New Britain, Conn.

[21] Appl. No.: 371,921

[22] Filed: Dec. 21, 1994

[51] Int. Cl.[6] ..... B44D 3/38

[52] U.S. Cl. ..... 33/414; 33/769; 220/617

[58] Field of Search ..... 33/414, 413, 769, 33/761; 277/214, 12, 184, 205; 220/617; 215/384, 385

[56] References Cited

U.S. PATENT DOCUMENTS

| | | | |
|---|---|---|---|
| 1,716,140 | 6/1929 | Kirwer | 220/617 |
| 3,126,637 | 3/1964 | Short | 33/414 |
| 3,706,393 | 12/1972 | Curtis et al. | 220/617 |
| 3,888,010 | 6/1975 | Hyde et al. | 33/414 |
| 4,197,656 | 4/1980 | Lane et al. | 33/414 |
| 4,592,148 | 6/1986 | Longenette | 33/414 |
| 4,660,291 | 4/1987 | Dehn | 33/414 |
| 4,765,557 | 8/1988 | Kahmann | 33/414 |
| 4,926,562 | 5/1990 | Hwu | 33/414 |

*Primary Examiner*—Christopher W. Fulton
*Attorney, Agent, or Firm*—Pepe & Hazard

[57] ABSTRACT

A casing for a chalk line dispenser comprises a pair of casing elements which interfit and define a chamber for storing chalk. The casing elements have end walls and sidewalls extending about the periphery thereof with interfitting surface portions along the outer ends thereof. The interfitting surface portion of one of the casing elements has a groove in the end surface of the sidewall extending about the periphery thereof and intermediate its width to provide resiliently deflectable depending wall sections. The interfitting surface portion on the other of the casing elements has a tongue extending about its periphery which seats in the groove and is of greater width than the groove to deflect the wall sections, so that the tongue is firmly gripped by the resiliently deflectable wall sections to provide a seal therebetween.

8 Claims, 1 Drawing Sheet

CHALKLINE TOOL

BACKGROUND OF THE INVENTION

The present invention relates to chalk line dispensers, and more particularly, to the housings of chalk line dispensers.

Chalk line dispensers are widely employed to mark straight lines along a work piece or work place. Generally, the chalk line dispenser housing or casing is comprised of a pair of mating elements which interfit and define a chamber for storing chalk and the line about a spool. Lap joints are commonly employed along the interfitting surfaces of the mating elements to prevent chalk leakage from the chalk chamber. Exemplary of such devices are those illustrated in Kahmann U.S. Pat. No. 4,765,557, Hwu U.S. Pat. No. 4,926,562, and Lane et al U.S. Pat. No. 4,197,656. It is difficult, however, to produce a tight fit for a half lap joint in normal manufacturing processes using standard tolerances and materials. As a result, the seal in conventional casings is often loose enough to permit some leakage of chalk powder from the chalk storage chamber, particularly when there are impacts upon the casing.

Accordingly, it is an object of the present invention to provide a novel casing for a chalk line dispenser which ensures a tight fit between its sections to prevent leakage of chalk powder from the chalk storage chamber.

It is also an object to provide such a casing which employs a seal which does not require relatively close tolerances to be effective.

Another object is to provide such a seal which enables simple and rapid assembly of the casing sections.

Still another object is to provide such a casing which may be readily fabricated from economically produced component parts to produce a long lasting rugged assembly.

SUMMARY OF THE INVENTION

It has now been found that the foregoing and related objects may be readily attained in a casing for a chalk line dispenser which comprises an interfitting pair of casing elements defining a chamber for storing chalk powder and chalk line. The casing elements have base walls and sidewalls extending about the periphery thereof with interfitting surface portions along the outer ends thereof. The interfitting surface portion on the sidewall of one of the elements includes a groove in the upper surface of the sidewall extending about the periphery thereof intermediate its width which provides resiliently deflectable wall sections on either side thereof. The interfitting surface portion on the sidewall of the other of the elements includes a tongue on the outer surface of the sidewall extending about the periphery thereof and seated in the groove of the one element. The tongue has a width greater than the width of the groove to deflect the wall sections, and the tongue is thus firmly gripped by the resiliently deflectable wall sections to provide a seal therebetween.

Generally, the outer end portion of the sidewall of the one element is stepped to provide one wall section which is shorter than the other, and shoulders on the ends of the wall sections of the groove. The upper end of the sidewall of the other element is cooperatively stepped to provide cooperating shoulders on either side of the tongue which abut the shoulders of the one element.

In the preferred embodiment, the shorter wall section is adjacent the inner side of the sidewalls. In addition, the tongue tapers to a reduced width towards its end and the groove tapers to a reduced width at its base. Desirably, the casing elements are fabricated from synthetic resin.

DETAILED DESCRIPTION OF THE PREFERRED EMBODIMENT

Figure 1:
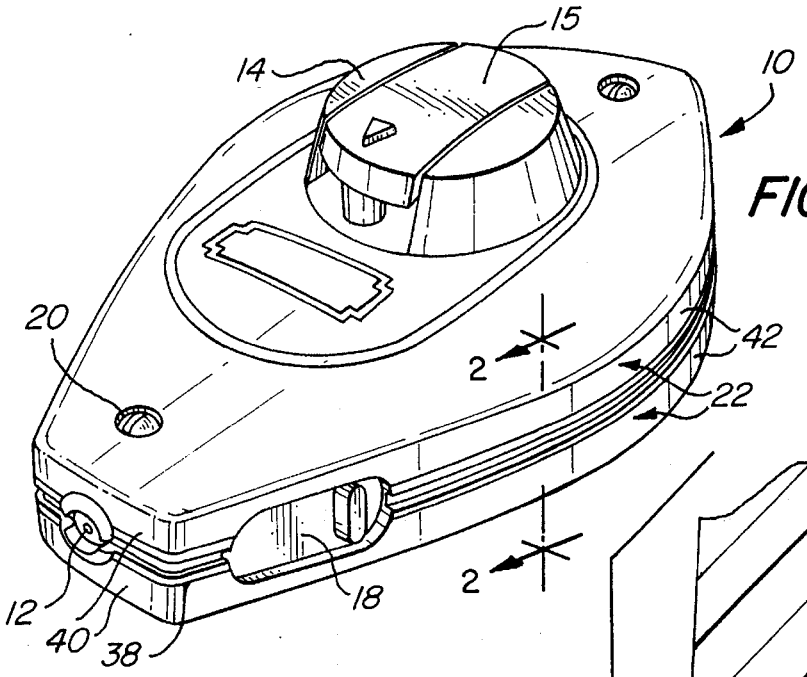
FIG. 1 is a perspective view of a chalkline dispenser utilizing a casing embodying the present invention.

Turning first to FIG. 1, therein illustrated is a chalk line dispensing and storage device generally designated by the numeral 10, having a pair of casing elements embodying the present invention generally designated by the numeral 22. The chalk line dispenser 10 includes an aperture 12 through which the chalk line or string (not shown) is drawn, and a rotatable handle 14 having a pivotable grip 15 for retracting the chalk string onto a reel (not shown) within the chalk line dispenser 10. The inside of the chalk line dispenser 10 also provides storage for chalk powder. A slidable closure 18 provides access to the chalk chamber (not shown) inside the chalk line dispenser 10 so that the chalk supply can to be replenished.

The pair of casing elements 22 are readily fastened together by fasteners 20. Each casing element 22 has a base wall 40 and a sidewall 42 extending about its periphery with an end portion 38, the end portions 38 of the two elements 22 interfitting as seen in FIGS. 2 and 3.

Figure 3:
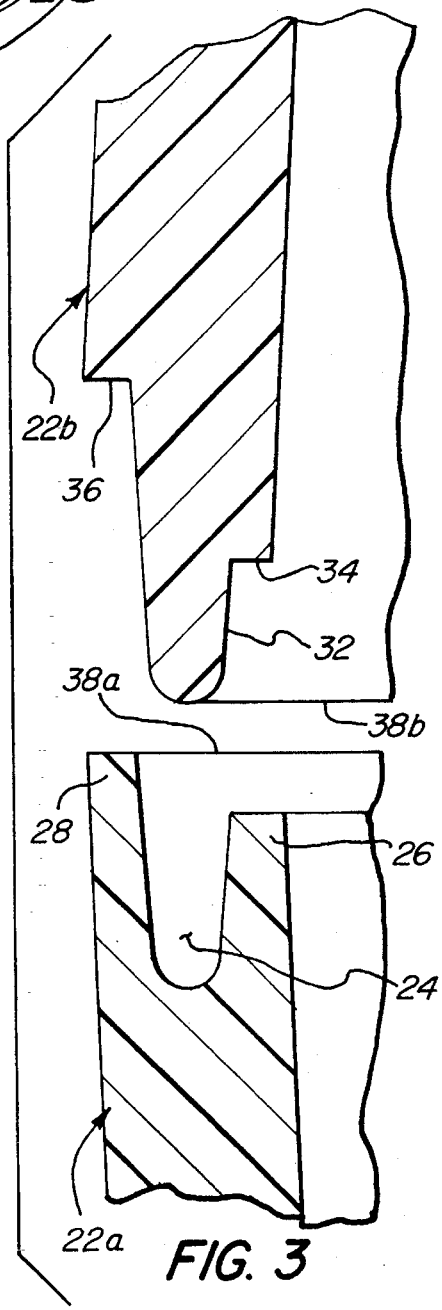
FIG. 3 is a sectional view similar to FIG. 2 but showing the female and male casing elements disengaged.

As best seen in FIG. 3, the end portion **38*a* of the casing element 22*a* has a female cross section provided by a groove 24 with a concave base intermediate the width of the side wall 42*a* which is bounded by two resiliently deflectable inner and outer depending wall sections 26 and 28. The end 38*a* has a stepped configuration so that the outer wall section 28 is of greater height than the inner wall section 26** which has a shoulder at its end.

The end portion **38*b* of the casing element 22*b* has a male cross section provided by a tongue 32 with a convex end intermediate the width of the side wall 42*b*. The end portion 38*b* is stepped so that the inner shoulder 34 is located spaced more closely to the outer end of the tongue 32 than the other shoulder 36**.

Figure 2:
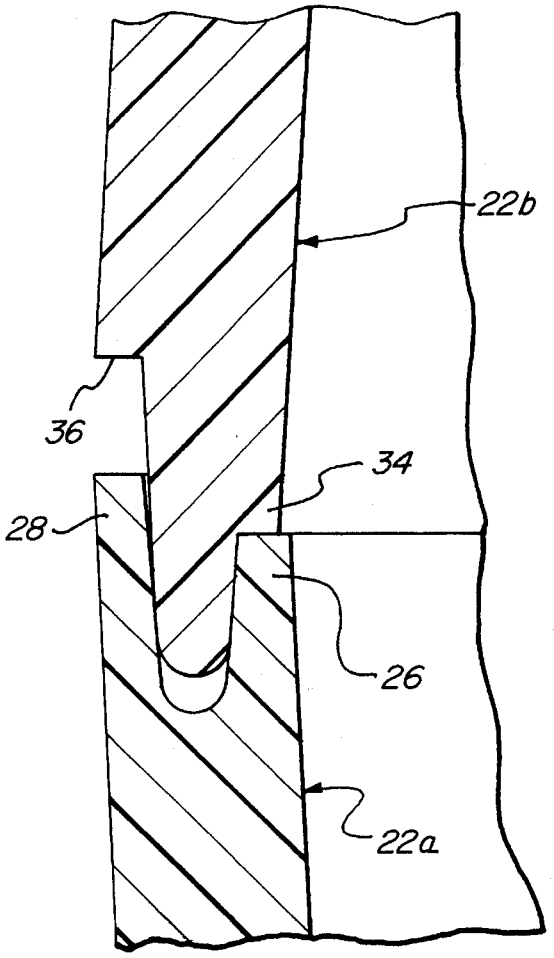
FIG. 2 is a fragmentary sectional view along line 2—2 of FIG. 1 drawn to a greatly enlarged scale, and showing the male and female casing elements engaged.

As best illustrated in FIG. 2 of the appended drawings, the tongue 32 of the casing element **22*b* seats in the groove 24 of the casing element 22*a* with the shoulder 34 of the casing element 22*b* abutting the inner wall section 26 of the female casing element 22*a***.

The tongue 32 tapers to a reduced width at its end to facilitate its assembly in the groove 24 of the casing element **22*a*. The groove 24 tapers to a reduced width at its base 46**.

During assembly, the tongue 32 is inserted into the groove 24 until the end of the inner wall 26 abuts the inner shoulder 34. The tongue 32 is slightly wider than the portion of the groove 24 in which it is seated; as a result, the wall sections 26 and 28 of the groove 24 are resiliently deflected by the tongue 32. This deflection, in turn, causes a frictional engagement between the tongue 32 and the wall sections 26 and 28 about the groove 24 to firmly grip the tongue 32 and provide a seal therebetween. The abutting surfaces of the tongue 32 and the groove 24 and the abutting surfaces between the inner wall section 26 and shoulder 34, provide a total of three areas which effectively seal the interior of the chalk line dispenser 10.

The tapered tongue 32 and the resiliently deflectable wall sections 26 and 28, also accommodate reasonable dimensional differences between the interfitting portions 38 of the casing element 22. This enables use of commercially available dimensional tolerances in manufacturing the components.

As will be appreciated, various materials may be employed for the construction of the chalk line dispenser case. Most conveniently, the casing elements are molded from a synthetic resin such as polypropylene which is resiliently deflectable, relatively inexpensive to mold, and durable.

As will further be appreciated, the configuration of the interfitting portions may vary from that which is illustrated in the accompanying drawings. For example, the inner wall section may be higher than the outer wall section, i.e., a reversal of the illustrated structure. Both shoulders about the tongue may abut with the end surfaces about the groove.

Thus, it can be seen from the foregoing detailed description and the attached drawings that the casing of the present invention effectively provides a seal between the interfitting surface portions of the chalk line dispenser casing elements thereby preventing any leakage of chalk powder from the interior of the chalk line dispenser. The interfitting halves of the case may be readily assembled and do not require tight tolerances to achieve an effective seal.

Having thus described the invention, what is claimed is:

1. A casing for a chalk line dispenser, comprising a pair of casing elements which interfit and define a chamber for storing chalk powder and chalk line, said elements having base walls and sidewalls extending about the periphery thereof with interfitting surface portions along the ends thereof, the interfitting surface portion on said sidewall of one of said elements including a groove in the end surface of said sidewall extending about the periphery thereof intermediate its width to provide resiliently deflectable wall sections on either side thereof, and the interfitting surface portion on the sidewall of the other of said elements including a tongue on the end surface of the sidewall extending about the periphery thereof and seated in said groove of said one element, said tongue having a width greater than the width of said groove to deflect said wall sections and said tongue being firmly gripped by said resiliently deflectable wall sections to provide a seal therebetween.

2. A chalk line dispenser according to claim 1 wherein the end portion of said sidewall of said one element is stepped to provide one wall section which is shorter than the other, and shoulders on either side of said groove, the end portion of said sidewall of said other section being cooperatively stepped to provide cooperating shoulders on either side of said tongue which abut said shoulders of said one section.

3. A chalk line dispenser according to claim 2 wherein said shorter wall section is adjacent the inner side of said sidewalls.

4. A chalk line dispenser according to claim 1 wherein said casing elements are fabricated from synthetic resin.

5. A chalk line dispenser according to claim 1 wherein said tongue tapers to a reduced width towards its end and said groove tapers to a reduced width at its base.

6. A casing for a chalk line dispenser, comprising a pair of casing elements which interfit and define a chamber for storing chalk powder and chalk line, said elements having base walls and sidewalls extending about the periphery thereof with interfitting surface portions along the ends thereof, the interfitting surface portion on said sidewall of one of said elements including a groove in the end surface of said sidewall extending about the periphery thereof intermediate its width to provide resiliently deflectable wall sections on either side thereof, and the interfitting surface portion on the sidewall of the other of said elements including a tongue on the end surface of the sidewall extending about the periphery thereof and seated in said groove of said one element, said tongue having a width greater than the width of said groove to deflect said wall sections and said tongue being firmly gripped by said resiliently deflectable wall sections to provide a seal therebetween, said casing elements being fabricated from synthetic resin, said tongue tapering to a reduced width towards its end, and said groove tapering to a reduced width at its base.

7. A chalk line dispenser according to claim 6 wherein the end portion of said sidewall of said one element is stepped to provide one wall section which is shorter than the other, and upwardly facing shoulders on either side of said groove, the upper end of said sidewall of said other section being cooperatively stepped to provide cooperating shoulders on either side of said tongue which abut said shoulders of said one section.

8. A chalk line dispenser according to claim 7 wherein said shorter wall section is adjacent the inner side of said sidewalls.

* * * * *